US007824833B2

(12) United States Patent
Kayamoto et al.

(10) Patent No.: US 7,824,833 B2
(45) Date of Patent: Nov. 2, 2010

(54) RESIN-COATED FERRITE CARRIER FOR ELECTROPHOTOGRAPHIC DEVELOPER, ITS PRODUCTION METHOD, AND ELECTROPHOTOGRAPHIC DEVELOPER USING THE RESIN-COATED FERRITE CARRIER

(75) Inventors: Kanao Kayamoto, Kashiwa (JP); Issei Shinmura, Kashiwa (JP); Toshio Honjo, Kashiwa (JP)

(73) Assignee: Powdertech Co., Ltd., Chiba (JP)

( * ) Notice: Subject to any disclaimer, the term of this patent is extended or adjusted under 35 U.S.C. 154(b) by 0 days.

(21) Appl. No.: 12/095,362

(22) PCT Filed: Nov. 30, 2006

(86) PCT No.: PCT/JP2006/323905

§ 371 (c)(1),
(2), (4) Date: Aug. 1, 2008

(87) PCT Pub. No.: WO2007/063933

PCT Pub. Date: Jun. 7, 2007

(65) Prior Publication Data

US 2009/0130587 A1 May 21, 2009

(30) Foreign Application Priority Data

Nov. 30, 2005 (JP) ..... 2005-347146

(51) Int. Cl.
*G03G 9/107* (2006.01)

(52) U.S. Cl. ..... 430/111.1; 430/111.3; 430/111.31; 430/111.32; 430/111.4; 430/111.41

(58) Field of Classification Search ..... 430/111.1, 430/111.3, 111.31, 111.32, 111.4, 111.41
See application file for complete search history.

(56) References Cited

U.S. PATENT DOCUMENTS 5,260,159 A * 11/1993 Ohtani et al. ..... 430/108.24
5,272,037 A * 12/1993 Ohtani et al. ..... 430/111.3

(Continued)

FOREIGN PATENT DOCUMENTS

JP 62-50839 3/1987

(Continued)

OTHER PUBLICATIONS

Machine English language translation of JP 08-001525, Jan. 10, 1996.*

(Continued)

*Primary Examiner*—Hoa V Le
(74) *Attorney, Agent, or Firm*—Greenblum & Bernstein, P.L.C.

(57) ABSTRACT

A spherical resin-coated ferrite carrier for an electrophotographic developer which can maintain a stable resistance and chargeability, a favorable charge rising property because of an excellent fluidity, and has a suitable durability, its production method which is excellent in economic efficiency and production stability, and an electrophotographic developer using the resin-coated ferrite carrier, are provided. A resin-coated ferrite carrier for an electrophotographic developer which is a spherical resin-coated ferrite carrier, wherein a carrier core material thereof has an irregular surface to improve the adhesive strength to a resin coat, and wherein the irregularity of the surface takes a finely streaked wrinkle pattern, its production method, and an electrophotographic developer using the resin-coated ferrite carrier, are employed.

17 Claims, 2 Drawing Sheets

U.S. PATENT DOCUMENTS

| | | | |
|---|---|---|---|
| 5,419,994 | A | 5/1995 | Honjo et al. |
| 5,900,343 | A | 5/1999 | Ochiai et al. |

FOREIGN PATENT DOCUMENTS

| | | |
|---|---|---|
| JP | 2-223962 | 9/1990 |
| JP | 3-233464 | 10/1991 |
| JP | 8-1525 | 1/1996 |
| JP | 10-104884 | 4/1998 |

OTHER PUBLICATIONS

An English language abstract of JP 10-104884.
An English language abstract of JP 2-223962.
An English language abstract of JP 62-50839.
An English language abstract of JP 3-233464.
U.S. Appl. No. 12/034,884, filed Feb. 21, 2008.
U.S. Appl. No. 12/036,673, filed Feb. 22, 2008.

* cited by examiner

RESIN-COATED FERRITE CARRIER FOR ELECTROPHOTOGRAPHIC DEVELOPER, ITS PRODUCTION METHOD, AND ELECTROPHOTOGRAPHIC DEVELOPER USING THE RESIN-COATED FERRITE CARRIER

TECHNICAL FIELD

The present invention relates to a resin-coated ferrite carrier for an electrophotographic developer used in two-component electrophotographic developers used in copying machines, printers and the like, its production method, and an electrophotographic developer using the resin-coated ferrite carrier, and particularly, relates to a spherical resin-coated ferrite carrier for an electrophotographic developer which maintains a stable resistance and chargeability, has a favorable charge rising property because of an excellent fluidity, and moreover has a suitable durability, its production method excellent in economical efficiency and production stability, and an electrophotographic developer using the resin-coated ferrite carrier.

BACKGROUND ART

The electrophotographic development method is a method of developing by adhering toner particles in a developer to electrostatic latent images formed on a photoreceptor. Developers used in this method are divided into two-component developers composed of toner particles and carrier particles, and one-component developers using toner particles alone.

The development method using the two-component developers composed of toner particles and carrier particles, among these developers, employed the cascade method in past, but predominantly employs the magnetic brush method using a magnet roll at present.

In two-component developers, carrier particles are a carrier material which imparts a desired charge to toner particles while they are mixed with the toner particles in a development box filled with a developer, and transports the charged toner particles to the surface of a photoreceptor to form toner images on the photoreceptor. The carrier particles remaining on a development roll holding a magnet are again returned into the development box, mixed and stirred with fresh toner particles, and used repeatedly in a certain period.

Two-component developers comprise, opposed to one-component developers, carrier particles with functions of charging toner particles by mixing and stirring both types of particles and transporting them, and can be designed more controllably. Therefore, two-component developers are suitable for full-color development devices requiring high-quality images, high-speed printing machines requiring reliability and durability of image sustention, and the like.

Two-component developers used in such a way requires that image characteristics such as the image density, fogging in image, white spots, gradation and resolution exhibit prescribed values from the initial period, and further, these characteristics do not vary during continuous printing period and be stably maintained. For stably maintaining these characteristics, the characteristics of carrier particles contained in two-component developers are required to be stable.

As carrier particles forming two-component developers, iron-powder carriers such as iron powders covered on their surface with an oxide film and iron powders coated on their surface with a resin are conventionally used. Since these iron-powder carriers have a high magnetization and a high conductivity, they have an advantage of easily providing well reproduced images on solid parts.

However, since such iron powder carriers have a high true specific gravity of about 7.8 and too high a magnetization, stirring and mixing with toner particles in a development box becomes liable to generate the fusion of toner constituents to the iron powder carrier surface, so-called toner spent. Such generation of toner spent reduces the available carrier surface area, and is liable to decrease the tribochargeability with toner particles.

The resin-coated iron powder carrier sometimes generates the charge leak due to exfoliation of the surface resin by stresses during endurance and exposure of the core material (iron powder), which has a high conductivity and a low dielectric breakdown voltage. Such charge leak breaks electrostatic latent images formed on a photoreceptor, and generates brush-marks and the like on solid parts, hardly obtaining uniform images. From these reasons, the iron powder carriers such as the oxide-filmed iron powder and resin-coated iron powder come not to be used at present.

In recent years, ferrites, which have a low true specific gravity of about 5.0 and also a low magnetization, are used as carriers in place of the iron powder carriers, and further resin-coated ferrite carriers, in which ferrites are coated on their surface with a resin, are often used, whereby the developer life has been remarkably elongated.

A production method of such a ferrite carrier commonly involves mixing ferrite carrier raw materials in prescribed amounts, calcining, milling, granulating, and thereafter sintering, and, depending on the situation, the calcination is sometimes omitted.

However, such a production method of ferrite carriers has various problems. Specifically, since the sintering process to generate the magnetization by the ferritization reaction commonly uses a tunnel kiln, and sinters raw materials filled in a sagger, the shape is liable to become irregular due to the mutual effect between the particles, especially remarkable in ferrite particles of smaller size, and after the sintering, the particles form blocks, and generate cracks and chips when they are disintegrated, which are incorporated as irregular particles. Besides, in the case of producing ferrite particles of small size, well-shaped particles cannot be made without enhanced milling. Further, since the sintering time necessitates about 12 h including the temperature-rising time, maximum temperature-holding time and temperature-falling time, and blocks formed of particles must be disintegrated after the sintering, the production method has a problem of not having the favorable production stability.

A carrier core material produced by such a sintering method has not only cracked and chipped particles, but many irregular particles, which are deformed particles, so even if a resin coat is formed, a uniform coating is difficult to form. The resin coat is thicker in recessed parts of the particle surface, and thinner in protruded parts thereof. In the parts having a thinner resin coat, the carrier core material is earlier exposed by stress, and the leak phenomenon and widening of the charge quantity distribution are caused, thereby having a difficulty in stabilizing high-quality images in a long period.

For achieving prevention of cracking and chipping, and reduction of irregular particles, prevention of aggregation between particles at the time of sintering is needed. For that, if the sintering is performed in a comparatively low sintering temperature, the stress at disintegration after the sintering becomes low, allowing reduction of cracked and chipped particles, and irregular particles, etc.

However, this case provides a porous particle surface property, a worsened charge-rising due to infiltration of a resin, etc. and much resin of needlessly infiltrated parts, and is economically inferior and unfavorable in both quality and cost.

For solving these problems, a new production method of a ferrite carrier is proposed. For example, Patent Document (Japanese Patent Laid-Open No. 62-50839) describes a production method of a ferrite carrier in which a formulation composed of metal oxides formulated as raw materials for forming a ferrite is passed through a high-temperature flame atmosphere, and is ferritized instantaneously thereby.

However, this production method is performed with the ratio of oxygen amount/combustible gas of not more than 3, so the sintering is difficult depending on the type of ferrite raw materials used. Further, it is not suitable for production of ferrites responding to smaller-sized particles in recent years, e.g. small-sized ferrites of about 20 to 50 μm, and cannot provide spherical uniform ferrite particles.

Patent Document 2 (Japanese Patent Laid-Open No. 3-233464) describes melting carrier raw materials by the direct current plasma method, high-frequency plasma method or hybrid plasma method as a production method of a carrier for an electrophotographic developer.

However, since this method uses an expensive gas such as argon or helium, it is economically very disadvantageous and is not practical.

[Patent Document 1] Japanese Patent Laid-Open No. 62-50839

[Patent Document 2] Japanese Patent Laid-Open No. 3-2233464

As described above, a production method which is excellent in the economical stability and productivity of a spherical resin-coated ferrite carrier for an electrophotographic developer which can maintain a stable resistance and chargeability, and is excellent in the fluidity and the charge rising property, has not been found.

DISCLOSURE OF THE INVENTION

Accordingly, an object of the present invention is to provide a spherical resin-coated ferrite carrier for an electrophotographic developer which can maintain a stable resistance and chargeability, and is favorable in the charge rising property because of an excellent fluidity, and has a suitable durability, and to provide its production method excellent in economical efficiency and production stability, and an electrophotographic developer using the resin-coated ferrite carrier.

As a result of extensive studies for solving the above-mentioned problems, the present inventors have found that by employing a production method of a resin-coated ferrite carrier in which a granulated material formed after preparation of a ferrite carrier feedstock is ferritized by thermal spray, then quenched and solidified, and thereafter a resin coat is formed on the surface of the obtained carrier core material, and by using a combustible gas and oxygen in a specific ratio for combustible gas flame used for this thermal spray, a produced resin-coated ferrite carrier has characteristics satisfying the above-mentioned object, and achieved the present invention.

Specifically, the present invention is to provide a spherical resin-coated ferrite carrier for an electrophotographic developer, wherein a carrier core material thereof has an irregular surface to improve the adhesive strength to a resin coat, and wherein the irregularity of the surface takes a finely streaked wrinkle pattern.

The resin-coated ferrite carrier for an electrophotographic developer according to the present invention has desirably an average particle size of 20 to 50 μm and a magnetization of 40 to 95 $Am^2/kg$.

The resin-coated ferrite carrier for an electrophotographic developer according to the present invention has preferably a ferrite composition containing at least one of Fe, Mn, Mg, Ca, Sr, Bi, Zr and Li.

The resin-coated ferrite carrier for an electrophotographic developer according to the present invention has desirably a resin coat amount of 0.1 to 10 wt. % based on the carrier core material.

The present invention is also to provide a method for producing a resin-coated ferrite carrier for an electrophotographic developer comprising: ferritizing, by thermal spray in the air, a granulated material formed after preparation of a ferrite carrier feedstock; then quenching and solidifying the ferritized granulated material; and forming a resin coat on a surface of the resultant carrier core material, wherein a combustible gas and oxygen are used for combustible gas flame for the thermal spray, and a volume ratio of the combustible gas and the oxygen is 1:3.5 to 6.0.

In the production method of a resin-coated ferrite carrier for an electrophotographic developer according to the present invention, preferably, the combustible gas is propane; a carrier gas of the granulated material is nitrogen, oxygen or air; and the flow rate of the granulated material is 20 to 60 m/s.

Further, the present invention is to provide an electrophotographic developer composed of the above-mentioned resin-coated ferrite carrier for an electrophotographic developer and a toner.

EFFECT OF THE INVENTION

The resin-coated ferrite carrier for an electrophotographic developer according to the present invention can form a uniform resin coat because of the carrier core material being substantially completely spherical; further, it has an improved joining strength of the particle surface with a resin, which does not infiltrate, provides a stable resistance, and a favorable maintainability of chargeability because of the finely streaked pattern formed on the surface; and moreover, it has a favorable charge rising property because of an excellent fluidity. Further, the durability by an anchor effect is expected because since the carrier has a peculiar surface property, the resin does not internally infiltrate at the time of resin coat. In the production method of the present invention, the magnetization and resistance do not vary; the sintering process can be simplified; and the disintegration process can be omitted; so the production method is superior in production stability and economic efficiency.

BEST MODE FOR CARRYING OUT THE INVENTION

Hereinafter, the preferred embodiments to practice the present invention will be described.

<The Resin-Coated Ferrite Carrier for an Electrophotographic Developer According to the Present Invention>

The resin-coated ferrite carrier for an electrophotographic developer according to the present invention has a spherical carrier core material (ferrite particles) of a nearly perfect sphericity. Since because the carrier core material has such a shape, it does not only provide a stable resistance and a favorable maintainability of chargeability, but also provides an excellent fluidity, the charge rising property is favorable.

The spherical shape as it is here referred to as, is a shape of 1 to 1.2 in average sphericity, preferably 1 to 1.1, further preferably 1 as nearly as possible. With the average sphericity exceeding 1.2, the spherical aspect of the carrier core material is damaged. The average sphericity as it is here referred to as, is denoted as follows. The carrier core material is photographed by a SEM at a magnification of 300 times by shifting the visual field so that the total number of more than 100 particles can be counted. SEM images are read by a scanner; the image analysis is conducted using an image analyzer soft "Image-Pro Plus", manufactured by Media Cybernetics Inc.; and the circumscribed circle diameter and the inscribed circle diameter of each particle are determined, and the sphericity is let denote the ratio. If the two diameters are equal, the ratio is 1, and in the case of a complete sphere, the ratio is 1. The average sphericity is let denote the average value determined for 100 particles.

The resin-coated ferrite carrier for an electrophotographic developer according to the present invention has a finely streaked wrinkle pattern on the carrier core material surface. Scanning electron micrographs of this carrier core material are shown in FIG. 1 (×5,000) and FIG. 2 (×3,300). Since the resin-coated ferrite carrier for an electrophotographic developer according to the present invention has thus a peculiar surface shape of the carrier core material, it is expected to have the durability due to an anchor effect because the resin does not infiltrate internally at the time of resin coat.

The resin-coated ferrite carrier for an electrophotographic developer according to the present invention has preferably an average particle size of 20 to 50 μm. With the average particle size of less than 20 μm, the carrier adhesion unfavorably becomes liable to occur. With that exceeding 50 μm, the image quality unfavorably becomes liable to degrade.

The resin-coated ferrite carrier for an electrophotographic developer according to the present invention has desirably a magnetization of 40 to 95 $Am^2/kg$. With the magnetization of less than 40 $Am^2/kg$, the carrier adhesion unfavorably becomes liable to be induced. With that exceeding 95 $Am^2/kg$, ears of magnetic brushes become high, unfavorably hardly obtaining high-quality images.

The resin-coated ferrite carrier for an electrophotographic developer according to the present invention has preferably a ferrite composition containing at least one of Fe, Mn, Mg, Ca, Sr, Bi, Zr and Li.

The resin-coated ferrite carrier for an electrophotographic developer according to the present invention has desirably a resin coat amount of 0.1 to 10 wt. % to the carrier core material. With the coating amount of less than 0.01 wt. %, it is difficult to form a uniform coating layer on the carrier surface. With that exceeding 10 wt. %, aggregation between carrier particles themselves occurs, causing the decrease in productivity including yield, and variations in developer characteristics in actual machines such as fluidity and charge quantity.

The coating resin to be used here is suitably selected depending on a toner in combination and the environment to be exposed to. The kind is not especially limited, but includes, for example, a fluororesin, acryl resin, epoxy resin, polyamide resin, polyamide-imide resin, polyester resin, unsaturated polyester resin, urea resin, melamine resin, alkyd resin, phenol resin, fluorinated acryl resin, acryl-styrene resin, silicone resin, and a modified silicone resin modified by a resin such as an acryl resin, polyester resin, epoxy resin, polyamide resin, polyamide-imide resin, alkyd resin, urethane resin or fluororesin. Taking into consideration dropping-off of the resin by mechanical stresses during use, a thermosetting resin is preferably used. The specific thermosetting resin includes an epoxy resin, phenol resin, silicone resin, unsaturated polyester resin, urea resin, melamine resin, alkyd resin and a resin containing these.

For the purpose of controlling the electric resistance, charge quantity and charging speed of the carrier, a conductive agent may be added to the coating resin. Too much an adding amount of the conductive agent is liable to cause a sharp charge leak because of a low electric resistance the conductive agent itself has. Therefore, the adding amount is 0.25 to 20.0 wt. % to the solid content of the coating resin, preferably 0.5 to 15.0 wt. %, especially preferably 1.0 to 10.0 wt. %. The conductive agent includes a conductive carbon, an oxide such as titanium oxide or tin oxide, and various kinds of organic conductive agents.

A charge control agent can be contained in the coating resin. Examples of the charge control agent include various kinds of charge control agents commonly used for toners, and various kinds of silane coupling agents. This is because the charge imparting capability sometimes decreases when the core material-exposed area is controlled so as to be made comparatively small by coat formation, but the capability can be controlled by addition of various kinds of charge control agents and silane coupling agents. Kinds of usable charge control agents and silane coupling agents are not especially limited, but are preferably charge control agents such as a nigrosine dye, quaternary ammonium salt, organic metal complex and metal-containing monoazo dye, and an aminosilane coupling agent, fluorinated silane coupling agent and the like.

<The Production Method of the Resin-Coated Ferrite Carrier for an Electrophotographic Developer According to the Present Invention>

Then, the production method of the resin-coated ferrite carrier for an electrophotographic developer according to the present invention will be described.

The production method of the resin-coated ferrite carrier for an electrophotographic developer according to the present invention involves ferritizing, by thermal spray in the air, a granulated material formed after preparation of a ferrite carrier feedstock, then quenching and solidifying the ferritized material, and thereafter, forming a resin coat on the surface of the obtained carrier core material.

The preparation method of a granulated material by using a ferrite carrier feedstock is not especially limited, but can employ conventionally known methods, and may use dry-process methods or wet-process methods.

An example of preparation methods of a granulated material involves weighing ferrite raw materials in suitable amounts, then adding water and milling to make a slurry, granulating the resultant slurry by a spray drier, and classifying the granulated material to prepare a granulated material of a prescribed size. The particle size of the granulated material is preferably about 20 to 50 μm in consideration of the particle size of a resin-coated ferrite carrier to be obtained. Another example involves weighing ferrite raw materials in suitable amounts, then mixing them, dry-milling them to mill and disperse the raw materials, granulating the mixture by a granulator, and classifying the granulated material to prepare a granulated material of a prescribed size.

The granulated material thus prepared is ferritized by thermal spray in the air. The thermal spray uses a combustible gas and oxygen for combustible gas flame, and the volume ratio of the combustible gas to oxygen is 1:3.5 to 6.0. If the ratio of oxygen to the combustible gas for combustible gas flame is less than 3.5, the fusion is not sufficient. If the ratio of oxygen to the combustible gas exceeds 6.0, the ferritization becomes difficult. For example, they are used in a ratio of 10 $Nm^3/h$ for the combustible gas to 35 to 60 $Nm^3/h$ for oxygen.

As a combustible gas used in the thermal spray, propane gas, propylene gas, acetylene gas, etc. is used, and especially propane gas is suitably used. As a granulated material carrier gas, nitrogen, oxygen or air is used. The flow rate of the granulated material is preferably 20 to 60 m/s.

The ferrite particles thus ferritized by the thermal spray are charged in water, and quenched and solidified.

Thereafter, the particles are recovered from the water, dried and classified. The particles are adjusted into a desired particle size by using an existing classifying method such as the air classification, mesh filtering method, precipitation method, etc. In the case of recovering in dry, the particles may be recovered by a cyclone and the like.

Thereafter, the electric resistance may optionally be adjusted by subjecting the particles to an oxide film treatment by heating their surface at a low temperature. The oxide film treatment involves, for example, a heat treatment at 300 to 700° C. using a common furnace such as a rotary electric furnace or batch-type electric furnace. The thickness of the oxide film formed by this treatment is preferably 0.1 nm to 5 μm. With the thickness of less than 0.1 nm, the effect of the oxide film layer is small; with that exceeding 5 μm, since the magnetization decreases and too high a resistance is generated, troubles such as decrease in the developing capability become liable to occur. Optionally, the reduction may be performed before the oxide film treatment.

Then, the above-mentioned resin is coated on the surface of the carrier core material to form a resin coat. Coating can be performed by a well-known coating method such as a brush coating method, spray-dry system by a fluidized bed, rotary-dry system and liquid immersion-dry method by a universal stirrer. For improving the coating ratio, the method by a fluidized bed is preferable.

In the case of baking the resin after the resin is coated on the carrier core material, either of an external heating system and an internal heating system may be used; for example, a fixed-type or a flow-type electric furnace, a rotary electric furnace, a burner furnace, or the microwave may be used for baking. In the case of using a UV curable resin, a UV heater is used. The baking temperatures are different depending on resins to be used, but a temperature of not less than the melting point or the glass transition temperature is needed, and for a thermosetting resin, condensation-crosslinking resin or the like, the temperature is required to be raised to a temperature where curing fully progresses.

<The Electrophotographic Developer According to the Present Invention>

Next, the electrophotographic developer according to the present invention will be described.

The electrophotographic developer according to the present invention is composed of the above-mentioned resin-coated ferrite carrier for an electrophotographic developer, and a toner.

The toner particles constituting the electrophotographic developer of the present invention include pulverized toner particles produced by pulverization, and polymerized toner particles produced by polymerization. In the present invention, the toner particles obtained by either of the methods can be used.

The pulverized toner particles are obtained by fully mixing, for example, a binding resin, a charge control agent and a colorant in a mixer such as a Henschel mixer, then melting and kneading by a biaxial extruder, etc., cooling, and thereafter pulverizing, classifying, adding with external additives, and mixing by a mixer, etc.

The binding resin constituting the pulverized toner particles is not especially limited, but includes a polystyrene, chloropolystyrene, styrene-chlorostyrene copolymer, styrene-acrylate copolymer, styrene-methacrylate copolymer, and further a rosin-modified maleic acid resin, epoxy resin, polyester resin and polyurethane resin. These are used singly or in a mixture thereof.

As the charge control agent, an optional one can be used. A positively chargeable toner includes, for example, a nigrosin dye and a quaternary ammonium salt, and a negatively chargeable toner includes, for example, a metal-containing monoazo dye.

As the colorant (coloring material), conventionally known dyes and pigments are usable. For example, carbon black, phthalocyanine blue, permanent red, chrome yellow, phthalocyanine green and the like can be used. In addition, external additives such as a silica powder and titania for improving the fluidity and cohesion resistance of the toner can be added depending on the type of toner particles used.

The polymerized toner particles are produced by a conventionally known method such as suspension polymerization, emulsion polymerization, emulsion coagulation, ester extension polymerization and phase transition emulsion. Such toner particles from polymerization are obtained, for example, as follows. A colored dispersion liquid in which a colorant is dispersed in water using a surfactant, a polymerizable monomer, a surfactant and a polymerization initiator are mixed and stirred in an aqueous medium to emulsify, disperse and polymerize the polymerizable monomer in the aqueous medium while stirring and mixing; thereafter, the polymerized dispersion is loaded with a salting-out agent to salt out the polymerized particles; and the particles obtained by the salting-out are filtered, washed and dried to obtain the polymerized toner particles. Thereafter, the dried toner particles are optionally loaded with external additives.

Further, in producing the polymerized toner particles, a fixability improving agent and a charge control agent can be blended other than the polymerizable monomer, surfactant, polymerization initiator and colorant, thus allowing to control and improve various properties of the polymerized toner particles obtained using these. Besides, for improving the dispersibility of the polymerizable monomer in the aqueous medium, and adjusting the molecular weight of the obtained polymer, a chain-transfer agent can be used.

The polymerizable monomer used for the production of the polymerized toner particles is not especially limited, but includes, for example, styrene and its derivatives, ethylenic unsaturated monoolefins such as ethylene and propylene, halogenated vinyls such as vinyl chloride, vinylesters such as vinyl acetate, and α-methylene aliphatic monocarboxylate such as methyl acrylate, ethyl acrylate, methyl methacrylate, ethyl methacrylate, 2-ethylhexyl methacrylate, acrylic acid dimethylamino ester and methacrylic acid diethylamino ester.

As the colorant (coloring material) used for preparing the polymerized toner particles, conventionally known dyes and pigments are usable. For example, carbon black, phthalocyanine blue, permanent red, chrome yellow and phthalocyanine green can be used. The surface of colorants may be improved by using a silane coupling agent, a titanium coupling agent and the like.

As the surfactant used for the production of the polymerized toner particles, an anionic surfactant, a cationic surfactant, an amphoteric surfactant and a nonionic surfactant can be used.

Here, the anionic surfactants include sodium oleate, a fatty acid salt such as castor oil, an alkylsulfate such as sodium laurylsulfate and ammonium laurylsulfate, an alkylbenzenesulfonate such as sodium dodecylbenzenesulfonate, an alkylnaphthalenesulfonate, an alkylphosphate, a naphthalenesulfonic acid-formalin condensate, a polyoxyethylene alkylsulfate, etc. The nonionic surfactants include a polyoxyethylene alkyl ether, a polyoxyethylene aliphatic acid ester, a sorbitan aliphatic acid ester, a polyoxyethylene alkyl amine, glycerin, an aliphatic acid ester, an oxyethylene-oxypropylene blockpolymer, etc. Further, the cationic surfactants include alkylamine salts such as laurylamine acetate, and quaternary ammonium salts such as lauryltrimethylammonium chloride, stearyltrimethylammonium chloride, etc. Then, the amphoteric surfactants include an aminocarboxylate, an alkylamino acid, etc.

The surfactant as described above is generally used in an amount within the range of 0.01 to 10 wt. % to a polymerizable monomer. Since the use amount of such a surfactant affects the dispersion stability of the monomer, and affects the environmental dependency of the obtained polymerized toner particles, it is preferably used in an amount within the above range where the dispersion stability of the monomer is secured, and the polymerized toner particles have not an excessive environmental dependency.

For the production of the polymerized toner particles, a polymerization initiator is generally used. The polymerization initiators come in a water-soluble polymerization initiator and an oil-soluble polymerization initiator, and either of them can be used in the present invention. The water-soluble polymerization initiator used in the present invention includes, for example, a peroxosulfate such as potassium peroxosulfate, and ammonium peroxosulfate, and a water-soluble peroxide compound. The oil-soluble polymerization initiator includes, for example, an azo compound such as azobisisobutyronitrile, and an oil-soluble peroxide compound.

In the case where a chain-transfer agent is used in the present invention, the chain-transfer agent includes, for example, mercaptans such as octylmercaptan, dodecylmercaptan and tert-dodecylmercaptan, carbon tetrabromide, etc.

Further, in the case where the polymerized toner particles used in the present invention contain a fixability improving agent, as the fixability improving agent, a natural wax such as a carnauba wax, and an olefinic wax such as a polypropylene and polyethylene can be used.

In the case where the polymerized toner particles used in the present invention contain a charge control agent, the charge control agent to be used is not especially limited, and a nigrosine dye, a quaternary ammonium salt, an organic metal complex, a metal-containing monoazo dye and the like can be used.

An external additive used for improving the fluidity etc. of the polymerized toner particles includes silica, titanium oxide, barium titanate, fluororesin microparticles, acrylic resin microparticles, etc., and these can be used singly or in a combination thereof.

Further, the salting-out agent used for separating polymerized particles from an aqueous medium includes metal salts such as magnesium sulfate, aluminum sulfate, barium chloride, magnesium chloride, calcium chloride and sodium chloride.

The average particle size of the toner particles produced as above is in the range of 2 to 15 μm, preferably in the range of 3 to 10 μm. The polymerized toner particles have a higher uniformity than the pulverized toner particles. The toner particles of less than 2 μm decrease the chargeability and are liable to bring about the fogging of image and toner scattering. Those exceeding 15 μm cause the degradation of image quality.

By mixing the carrier and the toner produced as above, an electrophotographic developer is obtained. The mixing ratio of the carrier to the toner, namely, the toner concentration, is preferably set to be 3 to 15%. With less than 3%, a desired image density is hard to obtain. With more than 15%, the toner scattering and fogging of image become liable to occur.

The electrophotographic developer according to the present invention mixed as above can be used in copying machines, printers, FAXs, printing presses and the like, in the digital system, which use the development system in which electrostatic latent images formed on a latent image holder having an organic photoconductor layer are reversal-developed by magnetic brushes of the two-component developer having the toner and the carrier while impressing a bias electric field. It is also applicable to full-color machines and the like which use an alternating electric field, which is a method to superimpose an AC bias on a DC bias, when the developing bias is applied from magnetic brushes to the electrostatic latent image side.

Hereinafter, the present invention will be specifically described by way of examples.

Instead of evaluations by actual machines, evaluations of charge quantity and resistance were conduced, which are the most important properties of characteristics of the developer using the carrier obtained in the present invention.

Example 1

Iron oxide, manganese oxide and magnesium oxide were weighed in a molar ratio of 50:40:10 to the total of 100 moles, and 0.5 mol of strontium oxide was added thereto to make a mixture together. The mixture was charged with water, and milled to make a slurry of a solid content of 50 wt. %. The resultant slurry was granulated by a spray drier, and classified to obtain a granulated material of 30 μm in average particle size.

Then, the obtained granulated material was charged in combustible gas flame from propane:oxygen=10 $Nm^3/h$:35 $Nm^3/h$ under a condition of a flow rate of 40 m/s, thermally sprayed into water to be quenched, recovered from the water, dried, and thereafter classified to produce ferrite particles (carrier core material).

The average sphericity, apparent density and fluidity of the obtained carrier core material were measured by the following methods. The results are shown in Table 1.

(Average Sphericity)

As described above, the carrier core material was photographed by a SEM at a magnification of 300 times by shifting the visual field so that the total number of more than 100 particles can be counted. The photographed SEM images were read by a scanner; the image analysis was conducted using an image analyzer soft "Image-Pro Plus", manufactured by Media Cybernetics Inc.; and the circumscribed circle diameter and the inscribed circle diameter of each particle were determined, and the sphericity was let denote the ratio. If the two diameters are equal, the ratio is 1, and in the case of a complete sphere, the ratio is 1. The average sphericity was let denote the average value determined for 100 particles.

(Apparent Density)

The apparent density was measured according to JIS-Z2504.

(Fluidity)

The fluidity was measured according to JIS-Z2502.

2 wt. % of a silicone resin SR-2411 (Dow Corning Toray Co., Ltd.) to the carrier core material and 3 wt. % of a carbon black to the resin solid content were dispersed, and the dispersed resin was coated on the carrier core material by a fluidized bed coating apparatus. After the resin coat, the resin was heated for baking at a temperature of 240° C. for 3 h. After the baking, the resin-coated carrier core material was screened through a net, and magnetically separated to produce a ferrite carrier A. The average particle size and the magnetic property of the ferrite carrier A are shown in Table 1. The average particle size and the magnetic property were measured by the following methods.

(Average Particle Size)

The average particle size was measured using a Microtrac Particle Size Analyzer (Model: 9320-X100), manufactured by Nikkiso Co., Ltd.

(Magnetic Property)

The magnetization was measured using an integral-type B-H tracer BHU-60 (produced by Riken Denshi Co., Ltd.). An H coil for measuring magnetic field and a 4πI coil for measuring magnetization were put in between electromagnets. In this case, a sample was put in the 4πI coil. Outputs of the H coil and the 4πI coil when the magnetic field H was changed by changing the current of the electromagnets were each integrated; and with the H output as the X-axis and the 4πI coil output as the Y-axis, a hysteresis loop is drawn on a chart. The measurement was conducted under the conditions of, the sample filling quantity: about 1 g, the sample filling cell: inner diameter of 7 mmϕ±0.02 mm, height of 10 mm±0.1 mm, and 4πI coil: winding number of 30.

190 g of the ferrite carrier A and 10 g of a commercially available negatively chargeable toner were weighed, charged in a glass bottle, and mixed by a Turbula mixer. The charge quantity and the resistance of the mixture at a prescribed time were measured, and their initial changing rates were also determined. These properties were substituted for the properties of the developer. The carrier resistance was measured after the toner was removed. The charge quantity and the resistance were measured using the following instruments. The measurement results are shown in Table 2 and Table 3.

(Charge Quantity)

The charge quantity was measured using an electric field-separated charge measuring instrument.

(Resistance)

The resistance was measured using a megohmmeter (manufactured by DKK-TOA Corp.).

Example 2

A granulated material was obtained as in Example 1, but with an average particle size of 26 μm under an altered classification condition.

Then, the obtained granulated material was charged in a combustible gas flame from propane:oxygen=10 $Nm^3/h$:50 $Nm^3/h$ under a condition of a flow rate of 40 m/s, thermally sprayed into water to be quenched, recovered from the water, dried, and thereafter classified to produce ferrite particles (carrier core material). The average sphericity, apparent density and fluidity of the carrier core material were measured as in Example 1. The results are shown in Table 1.

The carrier core material, as in Example 1, was coated with the resin, baked, and magnetically separated to produce a ferrite carrier B. The average particle size and the magnetic property of the ferrite carrier B were measured as in Example 1. The results are shown in Table 1. The charge quantity and the resistance were measured as in Example 1. The results are shown in Table 2 and Table 3.

Example 3

A granulated material was obtained as in Example 1, but with an average particle size of 33 μm under different classification conditions.

Then, the obtained granulated material, as in Example 2, was charged in a combustible gas flame from propane:oxygen=10 $Nm^3/h$:50 $Nm^3/h$ under a flow rate of 40 m/s, recovered in the air, quenched, and classified to produce ferrite particles (carrier core material). The average sphericity, apparent density and fluidity of the carrier core material were measured as in Example 1. The results are shown in Table 1.

The carrier core material, as in Example 1, was coated with the resin, baked, and magnetically separated to produce a ferrite carrier C. The average particle size and the magnetic property of the ferrite carrier C were measured as in Example 1. The results are shown in Table 1. The charge quantity and the resistance were measured as in Example 1. The results are shown in Table 2 and Table 3.

Example 4

Iron oxide and manganese oxide were mixed in a molar ratio of 80:20, charged with water, and milled to make a slurry of 50 wt. % in solid content. The resultant slurry was granulated by a spray drier, and classified to obtain a granulated material of 30 μm in average particle size.

Then, the obtained granulated material was charged under the same condition as in Example 2, thermally sprayed into water to be quenched, recovered from the water, dried, and thereafter classified to produce ferrite particles (carrier core material). The average sphericity, apparent density and fluidity of the carrier core material were measured as in Example 1. The results are shown in Table 1.

The carrier core material, as in Example 1, was coated with the resin, baked, and magnetically separated to produce a ferrite carrier D. The average particle size and the magnetic property of the ferrite carrier D were measured as in Example 1. The results are shown in Table 1. The charge quantity and the resistance were measured as in Example 1. The results are shown in Table 2 and Table 3.

Example 5

Iron oxide, manganese oxide and strontium oxide were mixed in a molar ratio of 70:29:1, charged with water, and milled to make a slurry of 50 wt. % in solid content. The resultant slurry was granulated by a spray drier, and classified to obtain a granulated material of 40 μm in average particle size.

Then, the obtained granulated material was charged under the same condition as in Example 2, thermally sprayed into water to be quenched, recovered from the water, dried, and thereafter classified to produce ferrite particles (carrier core material). The average sphericity, apparent density and fluidity of the carrier core material were measured as in Example 1. The results are shown in Table 1.

The carrier core material, as in Example 1, was coated with the resin, baked, and magnetically separated to produce a ferrite carrier E. The average particle size and the magnetic property of the ferrite carrier E were measured as in Example 1. The results are shown in Table 1. The charge quantity and the resistance were measured as in Example 1. The results are shown in Table 2 and Table 3.

Example 6

Iron oxide and magnesium oxide were mixed in a molar ratio of 70:30, and milled in dry state to mill and disperse the raw materials. The milled and dispersed mixture was granulated by a granulator, and classified to obtain a granulated material of 40 μm in average particle size.

Then, the obtained granulated material was charged under the same condition as in Example 1, thermally sprayed into a water bath, recovered from the water, dried, and thereafter classified to produce ferrite particles (carrier core material). The average sphericity, apparent density and fluidity of the carrier core material were measured as in Example 1. The results are shown in Table 1.

The carrier core material, as in Example 1, was coated with the resin, baked, disintegrated, and magnetically separated to produce a ferrite carrier F. The average particle size and the magnetic property of the ferrite carrier F were measured as in Example 1. The results are shown in Table 1. The charge quantity and the resistance were measured as in Example 1. The results are shown in Table 2 and Table 3.

Comparative Example 1

A granulated material was obtained as in Example 1, but with an average particle size of 37 μm under different classification conditions.

Then, the obtained granulated material was sintered in an electric furnace at a temperature of 1,300° C. in an oxygen concentration of 0.1%. The sintered material was disintegrated, and classified to produce ferrite particles (carrier core material). The average sphericity, apparent density and fluidity of the carrier core material were measured as in Example 1. The results are shown in Table 1.

The carrier core material, as in Example 1, was coated with the resin, baked, and magnetically separated to produce a ferrite carrier G. The average particle size and the magnetic property of the ferrite carrier G were measured as in Example 1. The results are shown in Table 1. The charge quantity and the resistance were measured as in Example 1. The results are shown in Table 2 and Table 3.

Comparative Example 2

A granulated material was obtained as in Example 1, but with an average particle size of 34 μm under an altered classification condition.

Then, the obtained granulated material was charged in a combustible gas flame from propane:oxygen=10 $Nm^3/h$:20 $Nm^3/h$ under a condition of a flow rate of 40 m/s, thermally sprayed into water to be quenched, recovered from the water, dried, and thereafter classified to produce ferrite particles (carrier core material). The average sphericity, apparent density and fluidity of the carrier core material were measured as in Example 1. The results are shown in Table 1.

The carrier core material, as in Example 1, was coated with the resin, baked, and magnetically separated to produce a ferrite carrier H. The average particle size and the magnetic property of the ferrite carrier H were measured as in Example 1. The results are shown in Table 1. The charge quantity and the resistance were measured as in Example 1. The results are shown in Table 2 and Table 3.

Comparative Example 3

A granulated material was obtained as in Example 4, but with an average particle size of 32 μm under an altered classification condition.

Then, the obtained granulated material was sintered in an electric furnace at a temperature of 1,350° C. in an oxygen concentration of 0.1%. The sintered material was disintegrated, and classified to produce ferrite particles (carrier core material). The average sphericity, apparent density and fluidity of the carrier core material were measured as in Example 1. The results are shown in Table 1.

The carrier core material, as in Example 1, was coated with the resin, baked, and magnetically separated to produce a ferrite carrier I. The average particle size and the magnetic property of the ferrite carrier I were measured as in Example 1. The results are shown in Table 1. The charge quantity and the resistance were measured as in Example 1. The results are shown in Table 2 and Table 3.

Comparative Example 4

A granulated material was obtained as in Example 1, but with an average particle size of 30 μm under an altered classification condition.

Then, the obtained granulated material was sintered in an electric furnace at a temperature of 1,200° C. in an oxygen concentration of 0.1%. The sintered material was disintegrated, and classified to produce ferrite particles (carrier core material). The average sphericity, apparent density and fluidity of the carrier core material were measured as in Example 1. The results are shown in Table 1.

The carrier core material, as in Example 1, was coated with the resin, baked, and magnetically separated to produce a ferrite carrier J. The average particle size and the magnetic property of the ferrite carrier J were measured as in Example 1. The results are shown in Table 1. The charge quantity and the resistance were measured as in Example 1. The results are shown in Table 2 and Table 3.

TABLE 1

| Physical property measurement results | | Carrier core material | | | Resin-coated carrier | |
|---|---|---|---|---|---|---|
| | | Average sphericity | Apparent density ($g/cm^3$) | Fluidity (S) | Average particle size (μm) | Magnetic property ($Am^2/kg$) |
| Example 1 | Carrier A | 1.05 | 2.69 | 23.1 | 32 | 73 |
| Example 2 | Carrier B | 1.05 | 2.62 | 29.8 | 27 | 74 |
| Example 3 | Carrier C | 1.02 | 2.67 | 24.3 | 35 | 73 |

TABLE 1-continued

| Physical property measurement results | | Carrier core material | | | Resin-coated carrier | |
|---|---|---|---|---|---|---|
| | | Average sphericity | Apparent density (g/cm$^3$) | Fluidity (S) | Average particle size (μm) | Magnetic property (Am$^2$/kg) |
| Example 4 | Carrier D | 1.06 | 2.73 | 27.2 | 33 | 93 |
| Example 5 | Carrier E | 1.06 | 2.77 | 28.7 | 40 | 74 |
| Example 6 | Carrier F | 1.04 | 2.65 | 27.5 | 39 | 74 |
| Comparative Example 1 | Carrier G | 1.36 | 2.34 | 37.6 | 40 | 73 |
| Comparative Example 2 | Carrier H | 1.05 | 1.97 | no flowing | 34 | 35 |
| Comparative Example 3 | Carrier I | 1.34 | 2.31 | 38.2 | 29 | 92 |
| Comparative Example 4 | Carrier J | 1.29 | 2.18 | 40.6 | 27 | 72 |

TABLE 2

| Charge quantity measurement results (unit: μc/g) | | | | | | | | |
|---|---|---|---|---|---|---|---|---|
| | | 0.5 hr | 1 hr | 5 hr | 10 hr | 24 hr | 48 hr | Initial changing rate |
| Example 1 | Carrier A | 24.4 | 21.4 | 23.6 | 25.2 | 27.1 | 26.8 | 1.1 |
| Example 2 | Carrier B | 22.5 | 23.6 | 22.8 | 24.2 | 27.3 | 27.4 | 1.2 |
| Example 3 | Carrier C | 25.6 | 24.6 | 24.9 | 26.3 | 26.9 | 27.3 | 1.1 |
| Example 4 | Carrier D | 24.9 | 23.5 | 23.1 | 24.3 | 25.1 | 26.9 | 1.1 |
| Example 5 | Carrier E | 26.2 | 25.3 | 25.6 | 26.1 | 25.3 | 24.6 | 0.9 |
| Example 6 | Carrier F | 25.5 | 23.6 | 24.2 | 25.5 | 24.1 | 26.1 | 1.0 |
| Comparative Example 1 | Carrier G | 16.8 | 18.9 | 20.2 | 23.7 | 31.3 | 32.4 | 1.9 |
| Comparative Example 2 | Carrier H | 4.9 | 4.1 | 8.6 | 10.2 | 12.1 | 15.6 | 3.2 |
| Comparative Example 3 | Carrier I | 12.5 | 14.2 | 19.5 | 21.8 | 28.3 | 31.5 | 2.5 |
| Comparative Example 4 | Carrier J | 5 | 6.6 | 9.5 | 12.3 | 15.2 | 19.3 | 3.9 |

TABLE 3

| Resistance measurement results (LogR) | | | | | | | | |
|---|---|---|---|---|---|---|---|---|
| | 100 V | 0.5 hr | 1 hr | 5 hr | 10 hr | 24 hr | 48 hr | Initial changing rate |
| Example 1 | Carrier A | 12.4 | 12.1 | 12.2 | 12.1 | 12.6 | 12.9 | 1.0 |
| Example 2 | Carrier B | 12.3 | 11.9 | 12.4 | 12.2 | 12.1 | 11.8 | 1.0 |
| Example 3 | Carrier C | 12.6 | 12.3 | 12.2 | 12.4 | 12.3 | 12.7 | 1.0 |
| Example 4 | Carrier D | 12.1 | 11.7 | 12.5 | 12.6 | 12.2 | 12.8 | 1.1 |
| Example 5 | Carrier E | 12.4 | 12.3 | 11.9 | 12.4 | 12.3 | 12.5 | 1.0 |
| Example 6 | Carrier F | 11.7 | 11.1 | 11.7 | 11.8 | 11.7 | 12.1 | 1.0 |
| Comparative Example 1 | Carrier G | 12.1 | 9.3 | 9.9 | 9.5 | 10 | 9.5 | 0.8 |
| Comparative Example 2 | Carrier H | 7.8 | 6.1 | 5.9 | 5.8 | 5.9 | 5.9 | 0.8 |
| Comparative Example 3 | Carrier I | 11.1 | 8.6 | 8.1 | 8.9 | 9.2 | 9.1 | 0.8 |
| Comparative Example 4 | Carrier J | 8.3 | 7.2 | 6.2 | 6.8 | 7.2 | 7.6 | 0.9 |

As is clear from the results shown in Table 1, the carrier core materials shown in Examples 1 to 6 are excellent in fluidity. This is believed to be attributed to the carrier core material having a spherical shape.

From the charge quantity measurement results shown in Table 2, the resin-coated ferrite carriers shown in Examples 1 to 6 are found to have a quickly rising charge quantity and a stable charge quantity with time. It is believed that a uniform resin coat is formed due to the carrier core material being spherical and its surface having a fine surface property, and that the excellently rising charge quantity and the stable charge quantity with time are achieved due to a high joining strength with the carrier core material.

Also with respect to the resistance measurement results of Table 3, the resin-coated ferrite carriers shown in Examples 1 to 6 are believed to exhibit a stable resistance under the influence of a uniformly formed resin coat and a high bonding strength with the resin coat.

These facts exhibit a great improvement over conventional arts with respect to the charge quantity and the resistance, which are important as developer characteristics.

By contrast, the resin-coated ferrite carriers obtained in Comparative Examples 1 to 4 are largely inferior in the above properties in comparison with Examples 1 to 6 as shown in Tables 1 to 3.

Specifically, although Comparative Examples 1 and 3 sintered in an electric furnace for smoothing the surface property are improved in the apparent densities, they have poor fluidities. The charge quantities after resin coat exhibit a very poor rising of charge quantity and an increase in the charge quantity possibly due to a poor uniformity of the coating. The resistance also has a tendency of decreasing with time, and is believed to decrease due to thin parts of the resin coat caused by that a uniform resin coat has not been formed.

Comparative Example 2 is believed not to have undergone a sufficient ferritization reaction, judging from the low magnetic property due to the poor heat amount in sintering.

Although Comparative Example 4 was sintered in an electric furnace, and underwent a sufficient ferritization reaction, in terms of the magnetic property, a resin coat is not well formed due to a porous particle surface, adverse effects such as a poor chargeability and low resistance are believed to emerge.

INDUSTRIAL APPLICABILITY

The resin-coated ferrite carrier for an electrophotographic developer according to the present invention, since having a substantially complete spherical shape, provides a stable resistance, and since having not only a favorable maintain ability of chargeability, but an excellent fluidity, has a favorable charge rising property. Besides, since the resin does not infiltrate internally at the time of resin coat due to the carrier having a peculiar surface property, the resin-coated ferrite carrier is expected to exhibit the durability due to an anchor effect. The production method of the resin-coated ferrite carrier for an electrophotographic developer according to the present invention, since the magnetization and the resistance do not change even without controlling the sintering atmosphere, can be simplified in the sintering process, and since the disintegration process can be omitted, is excellent in production stability and economic efficiency.

Accordingly, the production method according to the present invention is suitable as a production method of a resin-coated ferrite carrier for an electrophotographic developer in an industrial scale. Further, since an electrophotographic developer using the resin-coated ferrite carrier secures a sufficient image density, and can maintain high quality images in a long period, the developer is widely usable especially in the fields of full-color machines requiring high-quality images and high-speed machines requiring reliability and durability of image sustention.

Figure 1:
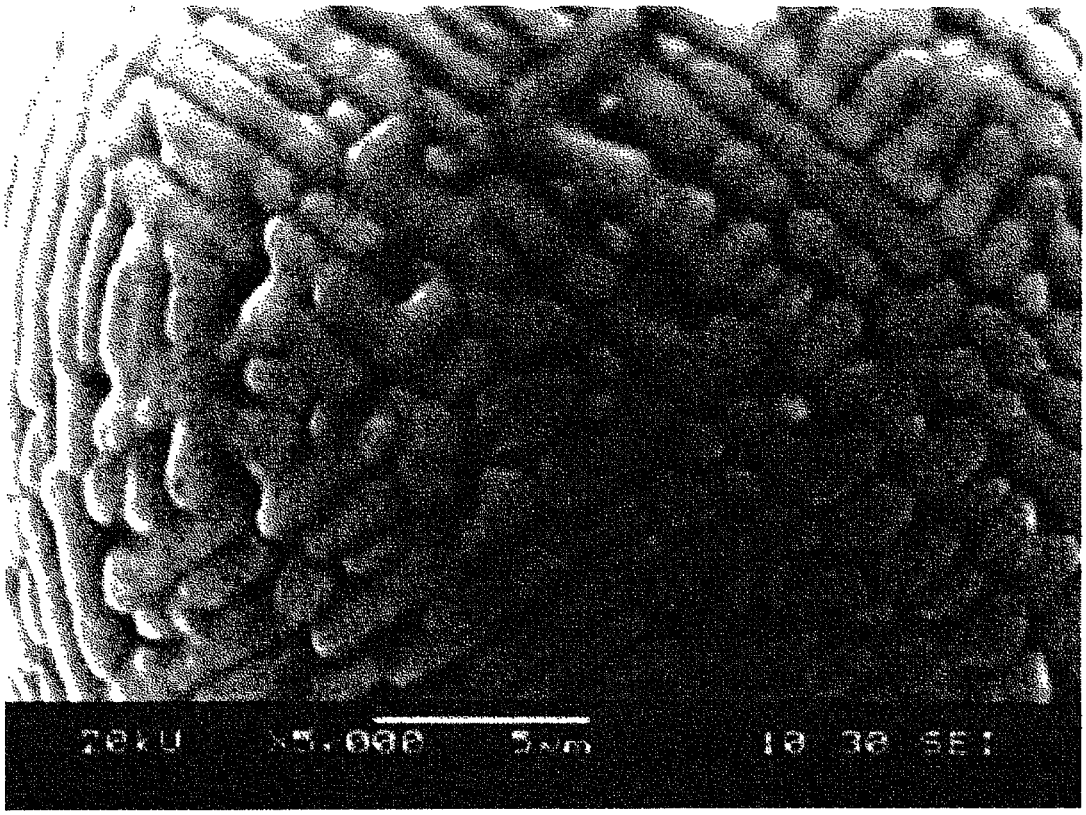
FIG. 1 is a scanning electron micrograph (×5,000) of a carrier core material used in a ferrite carrier for an electrophotographic developer according to the present invention.
Figure 2:
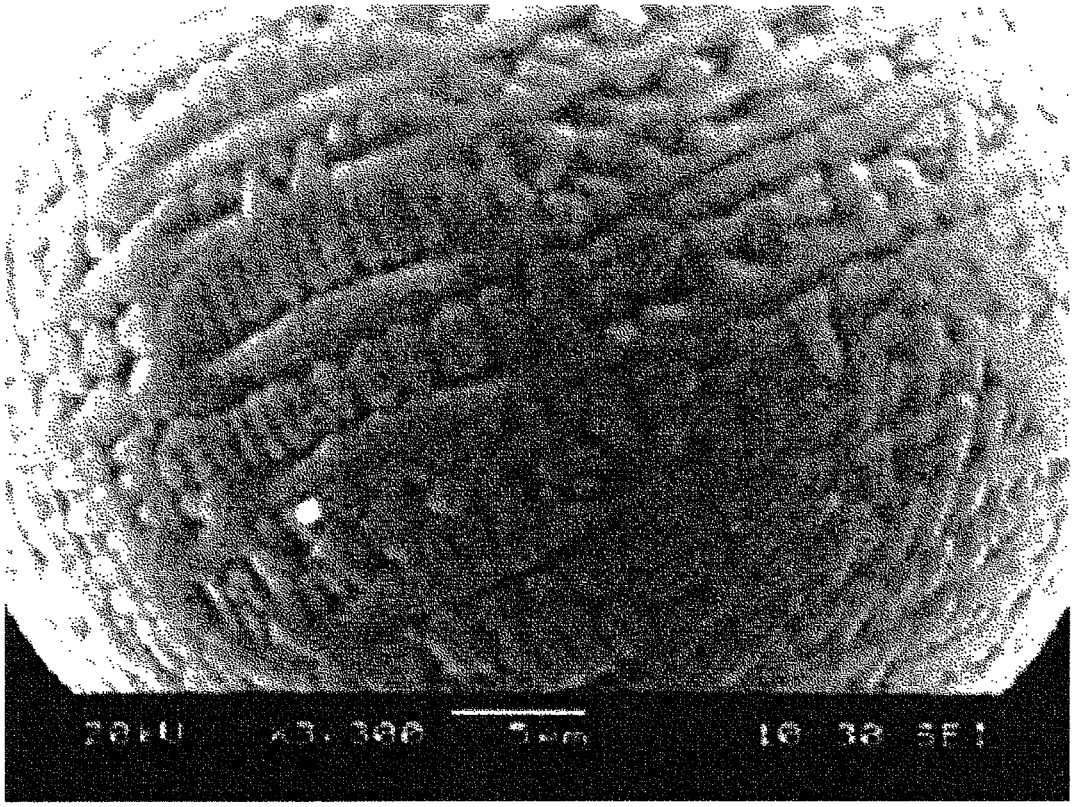
FIG. 2 is a scanning electron micrograph (×3,300) of a carrier core material used in a ferrite carrier for an electrophotographic developer according to the present invention.

The invention claimed is:

1. A spherical resin-coated ferrite carrier for an electrophotographic developer, wherein a carrier core material thereof has an irregular surface to improve the adhesive strength to a resin coat, and wherein the irregularity of the surface takes a finely streaked wrinkle pattern, the spherical resin-coated ferrite carrier is produced by a method comprising:

ferritizing, by thermal spray in air, a granulated material formed after preparation of a ferrite carrier feedstock;

then quenching and solidifying the ferritized granulated material; and forming a resin coat on a surface of the resultant carrier core material, wherein a combustible gas and oxygen are used for a combustible gas flame for the thermal spray, and a volume ratio of the combustible gas and the oxygen is 1:3.5 to 6.0; the combustible gas is propane; a carrier gas of the granulated material is nitrogen, air or oxygen;

and a flow rate of the granulated material is 20 to 60 m/s.

2. The resin-coated ferrite carrier for an electrophotographic developer according to claim 1, wherein the carrier has an average particle size of 20 to 50 μm, and a magnetization of 40 to 95 $Am^2/kg$.

3. The resin-coated ferrite carrier for an electrophotographic developer according to claim 1, wherein the ferrite composition contains at least one of Fe, Mn, Mg, Ca, Sr, Bi, Zr and Li.

4. The resin-coated ferrite carrier for an electrophotographic developer according to claim 1, wherein the resin coat is in an amount of 0.1 to 10 wt. % based on the carrier core material.

5. An electrophotographic developer comprising the resin-coated ferrite carrier for an electrophotographic developer according to claim 1, and a toner.

6. The resin-coated ferrite carrier for an electrophotographic developer according to claim 2, wherein the ferrite composition contains at least one of Fe, Mn, Mg, Ca, Sr, Bi, Zr and Li.

7. The resin-coated ferrite carrier for an electrophotographic developer according to claim 2, wherein the resin coat is in an amount of 0.1 to 10 wt. % based on the carrier core material.

8. The resin-coated ferrite carrier for an electrophotographic developer according to claim 3, wherein the resin coat is in an amount of 0.1 to 10 wt. % based on the carrier core material.

9. The resin-coated ferrite carrier for an electrophotographic developer according to claim 6, wherein the resin coat is in an amount of 0.1 to 10 wt. % based on the carrier core material.

10. An electrophotographic developer comprising the resin-coated ferrite carrier for an electrophotographic developer according to claim 2, and a toner.

11. An electrophotographic developer comprising the resin-coated ferrite carrier for an electrophotographic developer according to claim 3, and a toner.

12. An electrophotographic developer comprising the resin-coated ferrite carrier for an electrophotographic developer according to claim 4, and a toner.

13. An electrophotographic developer comprising the resin-coated ferrite carrier for an electrophotographic developer according to claim 6, and a toner.

14. An electrophotographic developer comprising the resin-coated ferrite carrier for an electrophotographic developer according to claim 7, and a toner.

15. An electrophotographic developer comprising the resin-coated ferrite carrier for an electrophotographic developer according to claim 8, and a toner.

16. An electrophotographic developer comprising the resin-coated ferrite carrier for an electrophotographic developer according to claim 9, and a toner.

17. The resin-coated ferrite carrier for an electrophotographic developer according to claim 1, wherein the carrier core material has a spherical shape having an average sphericity of 1 to 1.2.

* * * * *